US010219961B2

(12) United States Patent
Patel et al.

(10) Patent No.: US 10,219,961 B2
(45) Date of Patent: Mar. 5, 2019

(54) MOBILE CHAMBER APPARATUSES AND RELATED METHODS

(71) Applicant: HILL TOP RESEARCH INCORPORATED, St. Petersburg, FL (US)

(72) Inventors: Piyush Ranchodbhai Patel, Mississauga (CA); Anne Marie Salapatek, Mississauga (CA); Ronald Steven Salapatek, Mississauga (CA)

(73) Assignee: Hill Top Research Inc., St. Petersburg, FL (US)

( * ) Notice: Subject to any disclaimer, the term of this patent is extended or adjusted under 35 U.S.C. 154(b) by 0 days.

(21) Appl. No.: 15/320,552

(22) PCT Filed: Jun. 20, 2014

(86) PCT No.: PCT/CA2014/050589
§ 371 (c)(1),
(2) Date: Dec. 20, 2016

(87) PCT Pub. No.: WO2015/192201
PCT Pub. Date: Dec. 23, 2015

(65) Prior Publication Data

US 2017/0156961 A1 Jun. 8, 2017

(51) Int. Cl.
*A61G 10/02* (2006.01)
*A61G 10/00* (2006.01)
(Continued)

(52) U.S. Cl.
CPC ..... *A61G 10/02* (2013.01); *A61G 10/005* (2013.01); *E04B 1/34336* (2013.01);
(Continued)

(58) Field of Classification Search
CPC ..... E04H 15/20; E04H 2015/201; E04H 2015/204; E04H 15/34; E04H 15/42
See application file for complete search history.

(56) References Cited

U.S. PATENT DOCUMENTS 2,979,064 A 4/1961 Fischer
3,701,235 A 10/1972 Isaacson
(Continued)

FOREIGN PATENT DOCUMENTS

CA 2416328 A1 5/2002
ES 1055369 U 11/2003
(Continued)

OTHER PUBLICATIONS

Kumar et al. "Reversibility of airway inflammation and remodelling following cessation of antigenic challenge in a model of chronic asthma," Clin Exp Allergy, 34:1796-1802, 2004.
(Continued)

*Primary Examiner* — Kaylee R Wilson
(74) *Attorney, Agent, or Firm* — Eugene F. Derényi; Fogler, Rubinoff LLP

(57) ABSTRACT

A mobile chamber apparatus includes a support structure of inflatable support members, and a chamber assembly. The inflatable support members may include transverse and upright sections. The chamber assembly may include a top wall, a bottom wall, and one or more side walls. Connectors may detachably couple the support structure and the chamber assembly. Installed, the support structure supports the chamber assembly to enclose an interior space. Inlets may deliver a supply airflow to the interior space, and outlets may deliver a return airflow from the interior space. An environmental control unit may deliver the supply airflow and receive the return airflow. At least one mechanism may be provided for introducing an allergen into the interior space. Human patients may be exposed to the allergen in the
(Continued)

interior space, and therefore the mobile chamber apparatus may be used for clinical trials to study allergy response.

18 Claims, 11 Drawing Sheets

(51) Int. Cl.

| | |
|---|---|
| ***E04H 15/20*** | (2006.01) |
| ***E04H 3/08*** | (2006.01) |
| ***E04H 15/14*** | (2006.01) |
| ***E04B 1/343*** | (2006.01) |
| ***E04H 1/12*** | (2006.01) |

(52) U.S. Cl.
CPC ..... *E04H 1/1205* (2013.01); *E04H 3/08* (2013.01); *E04H 15/14* (2013.01); *E04H 15/20* (2013.01); *E04H 2015/201* (2013.01)

(56) References Cited

U.S. PATENT DOCUMENTS

| | | | | |
|---|---|---|---|---|
| 3,909,992 | A | 10/1975 | Stachiw | |
| 3,976,450 | A | 8/1976 | Marcote et al. | |
| 4,059,903 | A | 11/1977 | Piet et al. | |
| 5,205,086 | A * | 4/1993 | Heim | E04H 15/20 135/114 |
| 5,331,991 | A | 7/1994 | Nilsson | |
| 5,533,501 | A | 7/1996 | Denyer | |
| 5,747,002 | A | 5/1998 | Clark et al. | |
| 5,761,852 | A * | 6/1998 | Liu | E04H 15/20 446/220 |
| 5,830,058 | A | 11/1998 | Rosjo | |
| 5,865,171 | A | 2/1999 | Cinquin | |
| 5,893,237 | A | 4/1999 | Ryon et al. | |
| 5,935,516 | A | 8/1999 | Baugh | |
| 5,949,001 | A | 9/1999 | Willeke | |
| 6,192,633 | B1 | 2/2001 | Hilbert | |
| 9,217,258 | B2 | 12/2015 | Salapatek et al. | |
| 2003/0213512 | A1* | 11/2003 | Lee | E04H 15/20 135/126 |
| 2004/0054262 | A1 | 3/2004 | Horak | |
| 2005/0066968 | A1 | 3/2005 | Shofner et al. | |
| 2005/0247868 | A1 | 11/2005 | Call et al. | |
| 2007/0073369 | A1* | 3/2007 | Heaton K. | A61F 7/02 607/104 |
| 2007/0286804 | A1 | 12/2007 | Patel et al. | |
| 2008/0210234 | A1 | 9/2008 | O'Brien et al. | |
| 2008/0213248 | A1 | 9/2008 | Gu | |
| 2009/0246287 | A1 | 10/2009 | Shoseyov | |
| 2010/0192998 | A1 | 8/2010 | Villers et al. | |
| 2012/0316402 | A1 | 12/2012 | Salapatek et al. | |
| 2016/0006713 | A1 | 3/2016 | Salapatek et al. | |
| 2016/0022353 | A1 | 8/2016 | Patel et al. | |

FOREIGN PATENT DOCUMENTS

| | | | |
|---|---|---|---|
| JP | 10-314241 | A | 12/1998 |
| JP | 2004069399 | A | 3/2004 |
| JP | 2004069400 | A | 3/2004 |
| WO | 9916315 | A1 | 4/1999 |
| WO | 0032150 | A1 | 6/2000 |
| WO | 2007140601 | A1 | 12/2007 |
| WO | 2010099625 | A1 | 9/2010 |
| WO | 2015/192201 | A1 | 12/2015 |

OTHER PUBLICATIONS

Temelkovski et al. "An improved murine model of asthma: selective airway inflammation, epithelial lesions and increased methacholine responsiveness following chronic exposure to aerosolised allergen", Thorax, 53:849-856, 1998.
Ronborg et al. "Exposure chamber for allergen challenge" Allergy, 51:82-88, 1996.
Horak et al. "The house dust mite challenge model in the Vienna Challenge Chamber (VCC)" Allergy Clin Immunol News, 1994.
Perry et al. "Protective effect of montelukast on lower and upper respiratory tract responses to short-term cat allergen exposure" Ann Allergy Asthma Immunol, 93:431-438, 2004.
Phipatanakul et al. "The value of acoustic rhinometry in assessing nasal responses to cat exposure" J Allergy Clin Immunol, 102:896-901, 1998.
Day et al. "The role of allergen challenge chambers in the evaluation of anti-allergic medication: an international consensus paper" Clinical and Experimental Allergy Reviews, 6:31-59, 2006.
Committee for Medicinal Products for Human Use, European Medicines Agency "Guidelines on the clinical development of medical products for the treatment of allergic rhino-conjunctivitis" EMEA/EWP/2455/02.21, Oct. 2004.
U.S. Department of Health and Human Services. Food and Drug Administration, Center for Drug Evaluation and Research. "Allergic Rhinitis: Clinical Development Programs for Drug Products Draft Guidance", Apr. 2000.
Ronborg et al. "Exposure chamber for allergen challenge. A placebo-controlled, double-blind trial in house-dust-mite asthma" Allergy, 52:821-828, 1997.
Kawabata et al. "Physiology and pathophysiology of proteinases-activated receptors (PARs): PARs in the respiratory system: cellular signaling and physiological/pathological roles" J Pharmacol Sci, 97:20-24, 2005.
Donnelly et al. "Proteases in Helminth- and Allergen-Induced Inflammatory Responses" Chem Immunol Allergy, 90:45-64, 2006.
Maziak "The asthma epidemic and our articial habitats" BMC Pulmonary Medicine, 5:5, 2005.
Strachan "Hay fever, hygiene, and household size" BMJ, 299:1259-60, 1989.
Palmqvist et al. "Mild experimental exacerbation of asthma induced by individualised low-dose repeated allergen exposure. A double-blind evaluation" Respir Med, 92:1223-1230, 1998.
Cockcroft et al. "Comparative effects of inhaled salbutamol, sodium cromoglycate, and beclomethasone dipropionate on allergen-induced early asthmatic responses, late asthmatic responses, and increased bronchial responsiveness to histamine" J Allergy Clin Immunol, 79:734-740, 1987.
Herxheimer "The Late Bronchial Reaction in Induced Asthma" Int Arch Allergy Appl Immunol, 3:323-328, 1952.
Booij-Noord et al. "Late bronchial obstructive reaction to experimental inhalation of house dust extract" Clin Allergy, 2:43-61, 1972.
O'Byrne et al. "Late Asthmatic Responses" Am Rev Respir Dis, 166:740-751, 1987.
Woolcock et al. "Effect of therapy on bronchial hyperresponsiveness in the long-term management of asthma" Clin Allergy, 18:165-176, 1988.
Lowhagen et al. "Modification of bronchial hyperreactivity after treatment with sodium cromoglycate during pollen season" J Allergy Clin Immunol, 75:460-467, 1985.
Kirby et al. "Bronchoalveolar Cell Profiles of Asthmatic and Nonasthmatic Subjects" Am Rev Respir Dis, 136:379-383, 1987.
Wardlaw et al. "Eosinophils and Mast Cells in Bronchoalveolar Lavage in Subjects with Mild Asthma" Am Rev Respir Dis, 137:62-69, 1988.
Durham et al. "Eosinophils, bronchial hyperreactivity and late-phase asthmatic reactions" Clin Allergy, 15:411-418, 1985.
Taylor et al. "Peripheral blood eosinophil counts and bronchial responsiveness" Thorax, 42:452-456, 1987.
National Heart, Lung and Blood Institute "International Consensus Report on Diagnosis and Treatment of Asthma" Eur Respir J, 5:601-641, 1992.
Woodcock et al. "Allergen avoidance: does it work?" Br Med Bull, 56:1071-86, 2000.
Chapman et al. "Monitoring allergen exposure in asthma: new treatment strategies" Allergy, 50:29-33, 1995.
Chan-Yeung et al. "Mite and Cat Allergen Levels in Homes and Severity of Asthma" Am J Respir Crit Care Med, 152:1805-11, 1995.

(56) References Cited

OTHER PUBLICATIONS

Stubner et al. "A direct comparison of the efficacy of antihistamines in SAR and PAR: randomised, placebo-controlled studies with levocetirizine and loratadine using an environmental exposure unit—the Vienna Challenge Chamber (VCC)" Curr Med Res Opin, 20:891-902, 2004.
Stubner et al. "Efficacy and Safety of an Oral Formulation of Cetirizine and Prolonged-release Pseudoephedrine versus Xylometazoline Nasal Spray in Nasal Congestion" Arzneim-Forsch Drug Res, 51:904-910, 2001.
Horak et al. "Efficacy and safety relative to placebo of an oral formulation of cetirizine and sustained-release pseudoephedrine in the management of nasal congestion" Allergy, 53:849-56, 1998.
Horak et al. "Effect of continuous allergen challenge on clinical symptoms and mediator release in dust-mite-allergic patients" Allergy, 53:68-72, 1998.
Horak et al. "Controlled exposure to mite allergen for a dose-finding of dimethindene maleate (DMM)" Agents Actions, 41:C124-6, 1994.
Berkowitz et al. "Efficacy of fexofenadine in the prophylactic control of cat allergen-induced allergic rhinitis" Ann Allergy Asthma Immunol, 96:327-33, 2006.
Gibson et al. "Allergen-induced Asthmatic Responses. Relationship between increases in airway responsiveness and increases in circulating eosinophils, basophils, and their progenitors" Am Rev Respir Dis, 143:331-5, 1991.
Akerlund et al. "Clinical trial design, nasal allergen challenge models, and considerations of relevance to pediatrics, nasal polyposis, and different classes of medication" J Allergy Clin Immunol, 115:S460-82, 2005.
Krug et al. "Validation of an environmental exposure unit for controlled human inhalation studies with grass pollen in patients with seasonal allergic rhinitis" Clin Exp Allergy, 33:1667-74, 2003.
Berkowitz et al. "Onset of action, efficacy, and safety of fexofenadine 60 mg/pseudoephedrine 120 mg versus placebo in the Atlanta allergen exposure unit" Ann Allergy Asthma Immunol, 89:38-45, 2002.
Bryan et al. "Controlled Atmosphere Exposure Chamber" Arch Environ Health, 18:848-54, 1969.
Cloutier et al. "Validation of an Exposure System to Particles for the Diagnosis of Occupational Asthma" Chest, 102:402-407, 1992.
Davies. "Exposure of Hay Fever Subjects to an Indoor Environmental Grass Pollen Challenge System" Clinical Allergy, 15:419-427, 1985.
Day et al. "Cetirizine, Loratadine, or Placebo in Subjects with Seasonal Allergic Rhinitis: Effects After Controlled Ragweed Pollen Challenge in an Environmental Exposure Unit" J Allergy Clin Immunol, 101:638-645, 1998.
Day et al. "Comparative Onset of Action and Sympton Relief with Cetirizine, Loratadine, or Placebo in an Environmental exposure Unit in Subjects with Seasonal Allergic Rhinitis: Confirmation of a Test System" Ann Allergy Asthma Immunol, 87:474-481, 2001.
Day et al. "Experimental Models for the Evaluation of Treatment of Allergic Rhinitis" Ann Allergy Asthma Immunol, 96:263-278. 2006.
Day et al. "Onset of Action and Efficacy of Terfenadine, Astemizole, Cetirizine, and Loratadine for the Relief of Symptoms of Allergic Rhinitis" Ann Allergy Asthma Immunol, 79:163-172, 1997.
Day et al. "Respiratory Response to Formaldehyde and Off-Gas of Urea Formaldehyde Foam Insulation" Can Med Assoc J, 131:1061-1065, 1984.
Day "The Environmental Exposure Unit: A System to Test Anti-Allergic Treatment", Clin Exp All Rev, 3:82-86, 2003.
Written Opinion dated Mar. 17, 2015 in respect of International Application No. PCT/CA2014/050589.
International Preliminary Report on Patentability dated Dec. 20, 2016 in respect of International Application No. PCT/CA2014/050589.
customized Environmental Inflatable Party Tent, Inflatable Air Tent for Rental Business <http://www.inflatable-funcity.com/china-customized_environmental_infl . . . >, accessed Jun. 10, 2014.
HDT Global, 40 Series Airbeam Shelter, brochure, accessed Jun. 10, 2014.
Inflamax Research Inc., Inflamax Research Blog, <http://www.inflamaxresearch.com/blog/?p=5.>, accessed Jul. 3, 2014.
Inflamax Research Inc., The Next Generation of Mobile Environmental Exposure Chamber Systems for Allergy & Asthma Trials, brochure, accessed Jul. 3, 2014.
Naizil S.p. A., Naizil Soles-Plast, brochure, accessed Jun. 5, 2014.
Precontraint 832, Flame Retardant Textiles, brochure, accessed Jun. 5, 2014.
Schauenburg Flexadux Corporation, Schauenburg Ventilation, brochure, accessed Jun. 5, 2014.
StaticStop, a Division of SelecTech, Inc.,SelecTile ESD, Interlocking Static Control Tiles, brochure, accessed Jun. 5, 2014.
StaticStop, a Division of SelecTech, Inc., SelecTile ESD Installation Guide, brochure, accessed Jun. 5, 2014.
International Search Report dated Jul. 23, 2010 in respect of International Application No. PCT/CA2010/000325.
International Preliminary Report on Patentability dated Sep. 6, 2011 in respect of International Application No. PCT/CA2010/000325.
Office Action dated Oct. 17, 2014 in respect of U.S. Appl. No. 13/254,755.
Office Action dated Mar. 2, 2015 in respect of U.S. Appl. No. 13/254,755.
Liu et al., Environ. Sci. Techno., 2004, 38, 2802-2812.
Balansky et al., Carcinogensis, vol. 21, No. 9, 1677-1682, 2000.
Ernstgard et al., Toxicology Letters, 165, 2006, 22-30.
Braat et al., Am J Respir Crit Care Med, vol. 157, 1748-1755, 1998.
Day et al., Annals of Allergy, Asthma, Immunology, vol. 83, 83-89, 1999.
Office Action dated Dec. 16, 2015 in respect of U.S. Appl. No. 14/943,676.
Office Action dated May 24, 2016 in respect of U.S. Appl. No. 14/943,676.
Horak et al. "Efficacy and Tolerability of Astemizole-D and Loratadine-D During Prolonged, Controlled Allergen Challenge in the Vienna Challenge Chamber", Arzneim-Forsch Drug Res, 46:1077-1081, 1996.
Horak et al. "The Vienna Challenge Chamber—A New Method of Allergen Exposition Tests", Proceedings of Associations of Physicians and Congress Reports, Vienna, 1987.
Htut et al. "A Pilot Study on the Effect of One Room Mechanical Ventilation with Heat Recovery (MVHR) Units on House Dust Mite Populations and Der p 1 Levels in Laboratory Simulated Bedrooms and on Ambient Conditions in an Occupied Bedroom in Cambridge UK", International Journal of Environmental Health Research, 6:301-313, 1996.
Kyrein et al. "Efficacy of Intranasally Applied Dimethindene Maleate Solution as Spray in Adult Volunteers with Symptoms of Seasonal Allergic Rhinitis in the Vienna Challenge Chamber", Arzneim-Forsch Drug Res, 46:794-799, 1996.
Extended European Search Report dated Feb. 17, 2011 in respect of European Application No. 07719912.3.
Board of Appeals Decision dated Feb. 11, 2016 in respect of U.S. Appl. No. 11/450,786.
Office Action dated Feb. 13, 2012 in respect of U.S. Appl. No. 11/450,786.
Office Action dated Jun. 16, 2011 in respect of U.S. Appl. No. 11/450,786.
Office Action dated Jan. 4, 2011 in respect of U.S. Appl. No. 11/450,786.
Office Action dated Jun. 23, 2010 in respect of U.S. Appl. No. 11/450,786.
Advisory Action dated Apr. 23, 2010 in respect of U.S. Appl. No. 11/450,786.
Office Action dated Dec. 29, 2009 in respect of U.S. Appl. No. 11/450,786.
Office Action dated Jun. 12, 2009 in respect of U.S. Appl. No. 11/450,786.
Requirement for Restriction/Election dated Oct. 30, 2008 in respect of U.S. Appl. No. 11/450,786.
Requirement for Restriction/Election dated Jun. 26, 2008 in respect of U.S. Appl. No. 11/450,786.

(56) References Cited

OTHER PUBLICATIONS

International Preliminary Report on Patentability dated Dec. 10, 2008 in respect of International Application No. PCT/CA2007/000996.

* cited by examiner

MOBILE CHAMBER APPARATUSES AND RELATED METHODS

FIELD

The present disclosure relates to mobile enclosures. The present disclosure also relates to apparatuses for and methods of studying allergy and allergic asthma in humans.

BACKGROUND

The following paragraphs are not an admission that anything discussed in them is prior art or part of the knowledge of persons skilled in the art.

Allergy results when an allergic patient is exposed to an allergen for which they are sensitized. In the allergic individual, this may lead to early and late phase responses, which result in localized and systemic inflammation, and ultimately the allergy signs and symptoms of rhinitis and conjunctivitis are typical. The common nasal symptoms of rhinitis include nasal congestion, itchiness, runny nose and sneezing. The typical ocular symptoms of conjunctivitis include ocular hyperemia, itching and tearing. These symptoms have been shown to impact the day-to-day quality of life of its sufferers, and are known to have a socioeconomic impact. Allergic asthma is a more serious condition which involves the lower respiratory tract and may result in long-standing lung function disability, and even death.

Globally, allergy prevalence is increasing. Medications that may better address the underlying mechanisms of allergy and asthma are needed. In order to test anti-allergy medications towards approval for marketing, clinical trials need to be performed. The United States Federal Drug Agency (FDA) indicates that drugs approved for allergy need to demonstrate safety and efficacy in the treatment of allergy. This process requires that drugs are tested in three different phases: Phase I, Phase II, and Phase III. In order that drugs are well evaluated, it is important that testing is done in a non-biased fashion and in such a way that drugs are tested on enough patients to be representative of the general allergic population. As the drug progresses through the testing phases, studies become larger and often involve thousands of patients to be studied across many geographic and climatic regions and countries.

In allergy studies, the amount of symptoms that patients' exhibit tends to be directly related to their allergen exposure. There may be variability in the allergen exposure of different patients as allergen exposure is dependent on patient lifestyle, everyday environment, and, in the case of seasonal allergens (such as plant pollens like ragweed pollen), the natural level of allergen released. For seasonal allergens, a patient's allergen exposure may depend on their job type, for example, if they work daily in the office, allergen exposure may be lower than a patient who works as a gardener and is exposed to pollen release daily for long durations. The natural amount of allergen is further affected by climatic conditions, such as barometric pressure, temperature and rainfall. Taken together, there is even greater variability in patient symptoms and may result in difficulty assessing the true effect of drugs across different populations, locations and climates.

Allergen immunotherapy as a regulated therapy is a relatively recent treatment therapy which works to alter the underlying mechanisms of allergy. Since allergen immunotherapy is typically specific for one allergen type, and patients are often poly-allergic to multiple allergens which overlap in their release seasons, this adds to the complexity of immunotherapy testing. Further, perennial allergens, such as dust mite and cat allergens, are persistently released in some allergic patients' homes. Many patients are allergic to both seasonal and perennial allergens. Thus, despite the potential of allergen immunotherapy, the difficulty in assessing the effectiveness of immunotherapy therapy in one allergen type given the potential for variability in exposure poses a barrier to their true testing.

In response to this potential variability amongst patients and their daily allergen exposures during drug testing clinical trials, fixed facilities or allergen exposure rooms have been built in which airborne allergen levels are controlled and airborne allergen exposure to patients is also controlled. Typically, allergic patients who have a history of allergy to a specific allergen and a positive skin prick test to the same allergen are first screened with an allergen challenge in an allergen test facility for adequate symptom levels. This allows for an actual demonstration of allergy symptoms within the facility to be assessed by the patient or the investigator with symptom score cards, as well for various objective tests to be performed while the patients are in-house, such as nasal patency using acoustic rhinometry.

Some facilities accommodate dozens of patients in a theater-like configuration, and thereby allow the simultaneous testing of many patients ensuring consistency of allergen exposure across patients. Patients who are eligible from the screening session in the allergen chamber return to the chamber later, typically after a period of time greater than one week later (after the allergy symptoms have subsided). Patients are again challenged with allergen exposure in the test facility and either tested prophylactically or for treatment effect after symptom development in response to various test medications.

Individual responses and responses on average across a number of patients may be reproducible in the fixed allergen facility. This is an advantage over traditional field trial approaches, where patients are included in the clinical trial on the basis of medical history of allergy and without the actual demonstration of adequate symptoms that may be observed and rated directly within an allergen challenge test system by both the patient and the observer. In general, in a fixed allergen facility, patients are exposed to allergen at levels similar to that encountered on a peak pollen day and result in the provocation of patient allergy symptoms. Drugs which act prophylactically or after symptoms develop may be tested with these facilities.

Fixed allergen exposure facilities have been built to study allergy patients. For example, in 1999, Dr. Piyush Patel created the Environmental Exposure Chamber (EEC) model for study of allergic patients in Mississauga, Canada, and greater than 50 allergy and asthma studies have been conducted in the facility.

Furthermore, International Publication No. WO/2007/140601 discloses a method, materials and apparatus for investigating asthma using dust mite allergen in an environmental exposure chamber, and International Publication No. WO/2010/099625 discloses a method and chamber for exposure to non-allergic rhinitis trigger environments, and the entire contents of each are hereby incorporated herein by reference.

The Center for Biologics Evaluation Research of the FDA in their evaluation and guidelines for allergen specific immunotherapy testing have indicated their openness to consideration of multicenter allergen challenge test center studies. However, there remain difficulties standardizing existing fixed chambers. For example, one facility may be shown to have an allergen tolerance of ±500 pollen grains per cubic meter air, while another may have a tolerance of ±1000 pollen grains within sites within the test chamber. These differences in pollen levels may result in different levels of symptom response in the same patient. Furthermore, the varied proprietary designs of the chambers may preclude harmonization, and could dictate large rebuilds and expenditures even if it were possible to retrofit to provide similar spatial and temporal validation characteristics of allergen exposure to patients.

Introduction

The following paragraphs are intended to introduce the reader to the more detailed description that follows and not to define or limit the claimed subject matter.

In summary then, the research described above may not provide the capability to allow for a mobile allergen test system, which controls consistent levels of naturalistic airborne allergen exposure to patients. A mobile allergen test system that allows for accuracy and precision of drug testing, not only within one study site but also done at multiple centers in diverse locations, but also that will result in reproducible results across different studies conducted over different years or many countries or globally, is desirable. This may permit an ability to compare study findings directly for each drug tested, and ultimately to be able to compare directly between medications to assess relative drug risk benefit profiles important to patient treatment and drug regulation.

The present disclosure pertains to apparatuses for and methods of studying allergy and asthma in a safe and reproducible manner that may allow patient screening to recruit patients effectively who are truly symptomatic to the allergen tested, a consistent allergen exposure for all patients in the study, and a uniform and naturalistic level of control of airborne allergen exposure to control type and amount of allergen exposure applied safely.

According to an aspect of the present disclosure, a mobile chamber apparatus may include: a support structure including a plurality of inflatable support members; and a chamber assembly including a top wall, a bottom wall, and at least one side wall coupled between the top and bottom walls. In an installed state, the support structure may be coupled to the chamber assembly and may support the chamber assembly so that the top wall, the bottom wall and the at least one side wall enclose an interior space.

The apparatus may further include a plurality of connectors for detachably coupling the support structure and the chamber assembly.

At least a portion of the plurality of inflatable support members may include at least one transverse section, and the plurality of connectors may include first connectors that couple the transverse section to the top wall. The first connectors may include a plurality of cable elements, each of the cable elements fixed to and extending between an interior side of the transverse section and an exterior side of the top wall so that the top wall is at least partially suspended from the transverse section. The cable elements may be spaced apart generally along a length of the transverse section.

At least a portion of the plurality of inflatable support members may include at least one upright section, and the plurality of connectors may include second connectors that detachably couple the upright section to the at least one side wall. Each of the second connectors may include: at least one sleeve mounted to one of the upright section and an exterior side of the side wall; at least one base mounted to the other of the upright section and the exterior side of the side wall; and at least one elongate rod member that couples the base and the sleeve. The base and the sleeve may each slidingly receive the rod member. The at least one sleeve may be mounted generally along a height of the side wall, and the at least one rod member may extend generally along the height of the sidewall. The second connector may include a plurality of bases spaced apart generally along a height of the upright section, and the sleeve may include a plurality of openings, each of the plurality of openings positioned correspondingly to a respective one of the plurality of bases, the openings facilitating connection between the at least one rod member and the plurality of bases.

The apparatus may further include a plurality of spacer elements coupled between the plurality of inflatable support members. Each of the spacer elements may extend between and is fixed to an adjacent pair of the plurality of inflatable support members. Each of the spacer elements may include first and second ends that are each detachably connected to a respective upright section of the adjacent pair. At least a portion of the spacer elements may be coupled to the at least one side wall. The plurality of connectors may include third connectors that detachably couple the spacer element to the at least one side wall. The third connectors may include releasable loops that are fixed to the at least one side wall and receive the spacer element.

Each of the plurality of inflatable support members may include first and second elongate upright sections, and at least one transverse section extending between upper ends of the first and second upright sections. The at least one transverse section may include first and second elongate transverse sections, an outer end of each transverse section coupled to the upper end of a respective upright section. Inner ends of the transverse sections may be coupled together, and each of the first and second transverse sections may be inclined upwardly between the outer and inner ends. For each of the plurality of inflatable support members, the upright and transverse sections may be linked in fluid communication so that inflation of one of the sections causes inflation of each section. The support structure may further include a plurality of longitudinal sections that extend between the transverse sections. Each of the plurality of inflatable support members may be linked in fluid communication by the plurality of longitudinal sections so that inflation of one of the plurality of inflatable support members causes inflation of each of the plurality of inflatable support members.

The plurality of side walls may include a left side wall, a front side wall, a right side wall, and a back side wall. Each of the side walls may have generally equivalent width dimensions. The apparatus may further include at least one inlet disposed between an adjacent pair of the side walls for delivering a supply airflow to the interior space. The chamber assembly may further include a plurality of chamfered walls, and each of the plurality of chamfered walls may be arranged between an adjacent pair of the side walls. For each of the plurality of chamfered walls, an angle between the chamfered wall and each of the side walls of the adjacent pair may be substantially less than 90 degrees. The angle may be approximately 45 degrees. Each of the plurality of chamfered walls may have generally equivalent width dimensions, and the width dimension of the chamfered walls may be smaller than the width dimension of the side walls. The apparatus may further include at least one inlet disposed in at least one of the plurality of chamfered walls for delivering a supply airflow to the interior space. The apparatus may further include at least one outlet disposed in the top wall for delivering a return airflow from the interior space.

The chamber assembly may further include an airlock subchamber, at least one first door arranged between an exterior of the chamber assembly and the airlock subchamber, and at least one second door arranged between the airlock subchamber and the interior space.

The chamber assembly may be formed of at least one fabric material that provides a barrier to air and moisture, and provides a generally continuous seal between the top wall, the bottom wall, and the plurality of side walls. At least a portion of the chamber assembly may be formed of an electrostatically dissipative material.

The apparatus may further include at least one mechanism for introducing an allergen into the interior space.

The apparatus may be combined with an environmental control unit for delivering a supply airflow to the interior space having at least one of a controlled temperature and humidity. The environmental control unit may deliver a return airflow from the interior space.

According to an aspect of the present disclosure, a kit of parts may include: a plurality of inflatable support members, each of the plurality of inflatable support members including at least one transverse section and at least one upright section; a top wall; at least one side wall; a plurality of first connectors for coupling the transverse sections to the top wall; and a plurality of second connectors for coupling the upright sections to the at least one side wall. In an installed state, the transverse sections may support the top wall and the upright sections may support the at least one side wall so that the top wall and the at least one side wall enclose an interior space.

According to an aspect of the present disclosure, a method of installing a mobile chamber apparatus may include: at a first location, providing a support structure including a plurality of inflatable support members; at the first location, providing a chamber assembly including a top wall, a bottom wall, and at least one side wall coupled between the top and bottom walls; coupling the plurality of inflatable support members to the chamber assembly; and inflating the plurality of inflatable support members so that the support structure supports the chamber assembly and the top wall, the bottom wall and the at least one side wall enclose an interior space at the first location.

The step of inflating may be carried out subsequent to the step of coupling.

The step of coupling may include coupling transverse sections of the plurality of inflatable support members to the top wall. The step of coupling may include fixing a plurality of cable elements between the transverse sections and an exterior side of the top wall.

The step of coupling may include detachably coupling upright sections of the plurality of inflatable support members to the at least one side wall. The step of coupling may include sliding an elongate rod member to be received by a base mounted to one of the upright section and an exterior side of the at least one side wall and a sleeve mounted to the other of the upright section and the exterior side of the at least one side wall.

The method may further include connecting a plurality of spacer elements to the plurality of inflatable support members, each of the spacer elements extending between and fixed to an adjacent pair of the plurality of inflatable support members. The step of connecting may include detachably connecting each of first and second ends of the spacer element to a respective upright section of the adjacent pair. The step of connecting may include connecting at least portion of the spacer elements to the at least one side wall.

The method may further include, for each of the plurality of inflatable support members, linking upright and transverse sections in fluid communication so that, in the step of inflating, inflation of one of the sections causes inflation of each section.

The method may further include linking the plurality of inflatable support members in fluid communication by a plurality of longitudinal sections so that, in the step of inflating, inflation of one of the plurality of inflatable support members causes inflation of each of the plurality of inflatable support members.

The method may further include delivering a supply airflow to the interior space. The at least one side wall may include a plurality of side walls, and the supply airflow may be delivered to at least one inlet disposed between an adjacent pair of the plurality of side walls. The at least one side wall may include a plurality of side walls, and the supply airflow may be delivered to at least one inlet disposed in a chamfered wall arranged between an adjacent pair of the plurality of side walls. The method may further include cleaning the supply airflow and controlling at least one of temperature and humidity of the supply airflow.

The method may further include delivering a return airflow from the interior space. The return airflow may be delivered from at least one outlet disposed in the top wall.

The method may further include introducing an allergen into the interior space. The method may further include exposing at least one human patient to the allergen in the interior space. The method may further include assessing the exposure of the at least one human patient to the allergen.

The method may further include: decoupling at least a portion of the plurality of inflatable support members from the chamber assembly; deflating the plurality of inflatable support members; transporting the support structure and the chamber assembly to a second location remote from the first location; inflating the plurality of inflatable support members; and coupling the at least a portion of the plurality of inflatable support members to the chamber assembly.

According to an aspect of the present disclosure, a mobile chamber apparatus may include a support structure, and a chamber assembly. In an installed state, the support structure may support the chamber assembly so that the chamber assembly encloses an interior space. The apparatus may be combined with an environmental control unit for delivering a supply airflow to the interior space.

The combination may further include a plurality of inlets in a generally symmetrical arrangement for delivering the supply airflow to the interior space from the environmental control unit. The chamber assembly may include a plurality of side walls, and each of the side walls has generally equivalent width dimensions. The chamber assembly may further include a plurality of chamfered walls, and each of the plurality of chamfered walls may be arranged between an adjacent pair of the side walls. At least one of the plurality of inlets may be disposed in each of the plurality of chamfered walls.

The environmental control unit may deliver a return airflow from the interior space. The combination may further include a plurality of outlets in a generally symmetrical arrangement for delivering the return airflow to the environmental control unit from the interior space. The plurality of outlets may be positioned above the plurality of inlets. The chamber assembly may include a top wall, and the plurality of outlets may be disposed in the top wall.

The combination may further include at least one mechanism for introducing an allergen into the interior space.

According to an aspect of the present disclosure, a method may include: at a first location, installing a mobile chamber apparatus including a support structure supporting a chamber assembly so that the chamber assembly encloses an interior space; at the first location, coupling an environmental control unit to the apparatus to deliver a supply airflow to the interior space; introducing an allergen into the interior space; and exposing at least one human patient to the allergen in the interior space.

The supply airflow may be delivered to the interior space in a generally symmetrical manner. The method may further include, at the environmental control unit, delivering a return airflow from the interior space. The return airflow may be delivered from the interior space in a generally symmetrical manner. The return airflow may be delivered from the interior space at a position above where the supply airflow is delivered to the interior space.

The method may further include, at the environmental control unit, cleaning the supply airflow and controlling at least one of temperature and humidity of the supply airflow.

The method may further include: transporting the mobile chamber apparatus and the environmental control unit to a second location remote from the first location; at the second location, installing the mobile chamber apparatus so that the chamber assembly encloses the interior space; at the second location, coupling the environmental control unit coupled to the apparatus for delivering a supply airflow to the interior space; introducing an allergen into the interior space; and exposing at least one human patient to the allergen in the interior space.

Other aspects and features of the teachings disclosed herein will become apparent, to those ordinarily skilled in the art, upon review of the following description of the specific examples of the present disclosure.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Various apparatuses or methods will be described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

Figure 1:
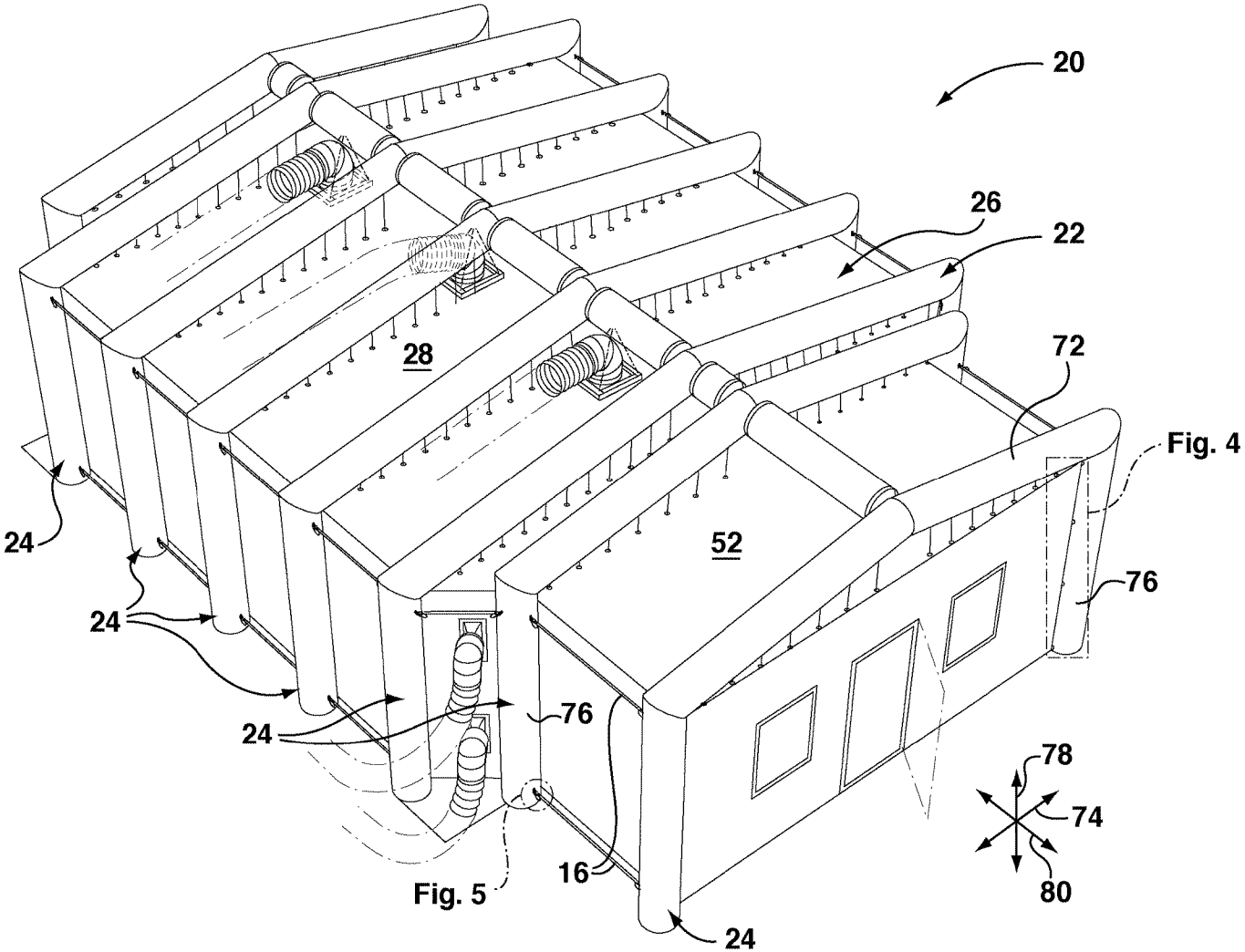
FIG. 1 is front perspective view of a mobile chamber apparatus.
Figure 2:
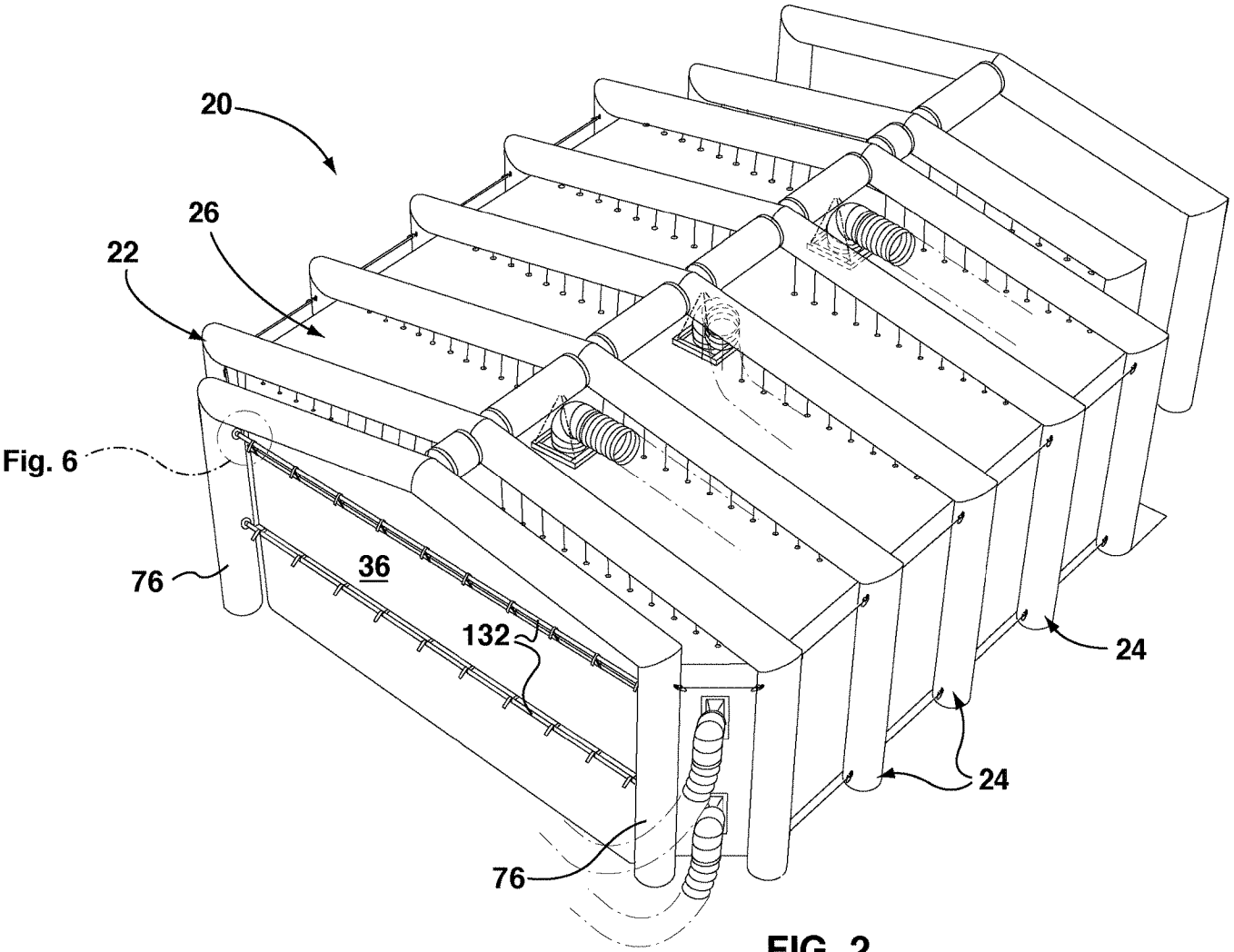
FIG. 2 is a rear perspective view of the mobile chamber apparatus of FIG. 1.

Referring to FIGS. 1 and 2, a mobile chamber apparatus is illustrated generally at 20. The apparatus 20 includes a support structure 22. The support structure 22 includes several inflatable support members 24. The apparatus 20 further includes a chamber assembly 26. In the example illustrated, the support structure 22 is external of the chamber assembly 26, and supports the chamber assembly 26 in an installed state.

Figure 3:
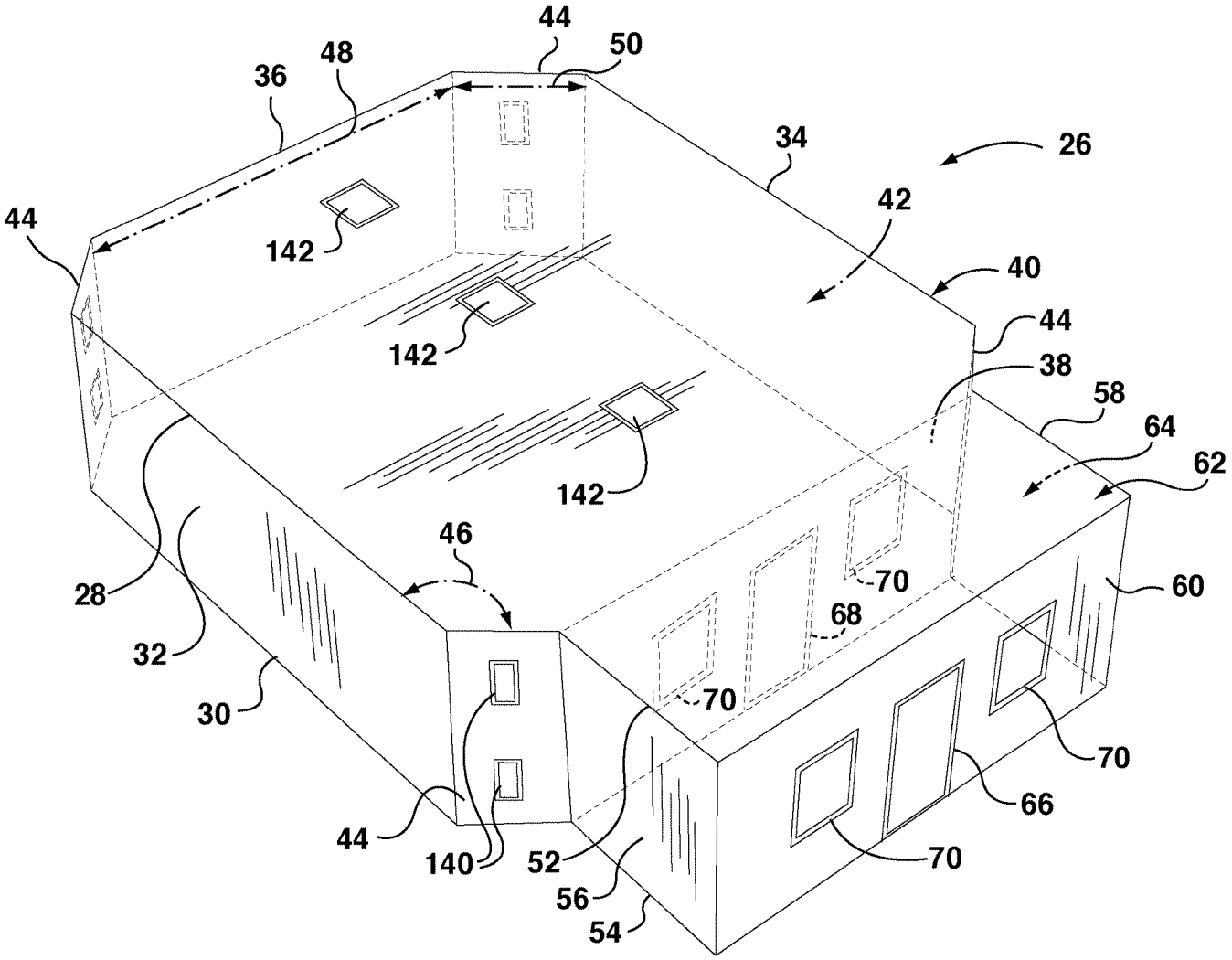
FIG. 3 is front perspective view of a chamber assembly of the mobile chamber apparatus of FIG. 1.

Referring to FIG. 3, the chamber assembly 26 is shown to include a top wall 28, a bottom wall 30, a left side wall 32, a right side wall 34, a back side wall 36 and a front side wall 38. The side walls 32, 34, 36, 38 are shown to extend between the top and bottom walls 28, 30, and define an allergen test chamber 40 having an interior space 42.

In the example illustrated, the chamber assembly 26 further includes chamfered walls 44. Each of the chamfered walls 44 is shown arranged between an adjacent pair of the side walls 32, 34, 36, 38. The chamfered walls 44 are arranged at an angle (e.g., angle 46) relative to the side walls 32, 34, 36, 38, which may be substantially less than 90 degrees, and may be approximately 45 degrees. This design may help to ensure adequate allergen mixing within the interior space 42 with reduced corner resistance.

In the example illustrated, each of the side walls 32, 34, 36, 38 has an equivalent width dimension (e.g., width dimension 48), and each of the chamfered walls 44 has an equivalent width dimension (e.g., width dimension 50), with the chamfered walls 44 being much smaller than the side walls 32, 34, 36, 38.

In the example illustrated, the chamber assembly 26 further includes a top wall 52, a bottom wall 54, a left side wall 56, a right side wall 58 and a front side wall 60. The side walls 56, 38, 58, 60 are shown to extend between the top and bottom walls 52, 54, and define an airlock subchamber 62 having an interior space 64. The airlock subchamber 62 may allow for the retention of allergen within the allergen test chamber 40, and this may be assisted by a slight pressure gradient maintained between the interior spaces 42, 64. The airlock subchamber 62 may also be used to house work stations to assist with the allergen testing, e.g., for acoustic rhinometry, slit lamp exam, or blood taking.

A first door 66 is shown arranged in the front side wall 60 for accessing the interior space 64 of the airlock subchamber 62 from the exterior of the chamber assembly 26. A second door 68 is shown arranged in the front side wall 38 for accessing the interior space 42 of the allergen test chamber 40. The doors 66, 68 may be selected to provide roughly an air tight and moisture tight seal between the different environments.

The front side walls 38, 60 are also shown to include windows 70. The windows may allow for clinical monitoring of patients within the interior spaces 42, 64 for patient compliance to instructions for symptom assessment and drug dosing The windows 70 may be formed of PVC or other reduced-static materials, optionally with antistatic coatings to prevent or at least reduce allergen accumulation.

The chamber assembly 26 may be formed of several pieces of fabric material that provides a barrier to air and moisture, and the various walls may be joined to one another in a suitable manner (e.g., with an adhesive, stitching, heat welding and/or ultrasonic welding) in order to provide a generally continuous seal between the pieces. In some examples, the top walls 28, 52 may be formed of a single piece of fabric material, or they may be separate pieces and joined in a suitable manner. Similarly, the side walls 56, 38, 58, 60 and the chamfered walls 44 may be formed of a single piece of material that extends about the periphery of the allergen test chamber 40, or they may be formed of several pieces of material joined together.

In any case, the fabric material may be non-porous to provide a barrier to air and moisture so that the environment within the interior space 42 of the allergen test chamber 40 may be carefully controlled. Furthermore, the chamber assembly 26 may be formed of a lightweight, flexible, durable and fire retardant material. Moreover, at least a portion of the chamber assembly 26 may be formed of an electrostatically dissipative material, to prevent the buildup of static charge in the interior space 42 of the allergen test chamber 40, and furthermore this material may be grounded.

By way of example, and not intended to be limiting, for forming the chamber assembly 26 the inventors have had satisfactory results using a PVC reinforced fabric material with electrically dissipative properties, sold under the name SOLEIL SOLE-PLAST™ (Naizil S.p.A. of Campodarsego, Italy). The inventors have also found that ultrasonic welding of this material to form the chamber assembly 26 produces consistent and precise connections between the various components.

Referring to FIG. 1, each of the support members 24 are shown to include transverse sections 72. The transverse sections 72 are shown to be elongate, generally cylindrical in shape with a hollow interior, and extend generally in a first horizontal or transverse direction 74. Each of the support members 24 are also shown to include upright sections 76. The upright sections 76 are shown to be elongate, generally cylindrical in shape with a hollow interior, and extend generally in a vertical direction 78. Each of the support members 24 are shown to extend generally in the transverse direction 74, and are spaced apart from one another in a second horizontal or longitudinal direction 80.

Figure 9:
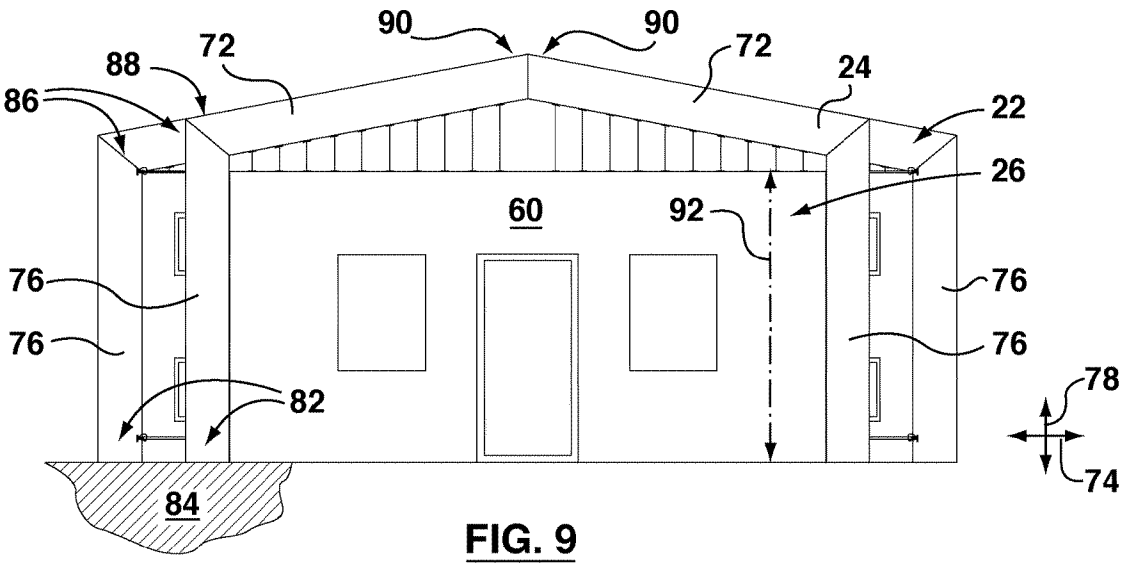
FIGS. 9, 10 and 11 are front, side and top views, respectively, of the mobile chamber apparatus of FIG. 1.

Referring to FIG. 9, the support members 24 are shown to each include two transverse sections 72 and two uprights sections 76, thereby defining an upside-down, U-shaped structure. In the example illustrated, sizing of the support members 24 is varied, with the support members 24 surrounding the allergen test chamber 40 being significantly larger than the support members 24 surrounding the airlock subchamber 62 (FIG. 3).

For each of the support members, the hollow interiors of the sections 72, 76 may be linked in fluid communication so that inflation of one of the sections causes inflation of each section. This may help to simplify inflation because only one inflation point may be necessary to inflate the entire support member 24. However, it may still be desirable to have more than one inflation point, depending on the volume of air required to inflate the entire support member 24.

In the example illustrated, each of the upright sections extends between a lower end 82 resting on a ground surface 84, and an upper end 86 spaced apart from the lower end 82 in the vertical direction 78. The upright sections 76 are each shown to span the full height 92 of the chamber assembly 26. An outer end 88 of the transverse section 72 is connected to the upper end 86 of the respective upright section 76.

Figure 11:
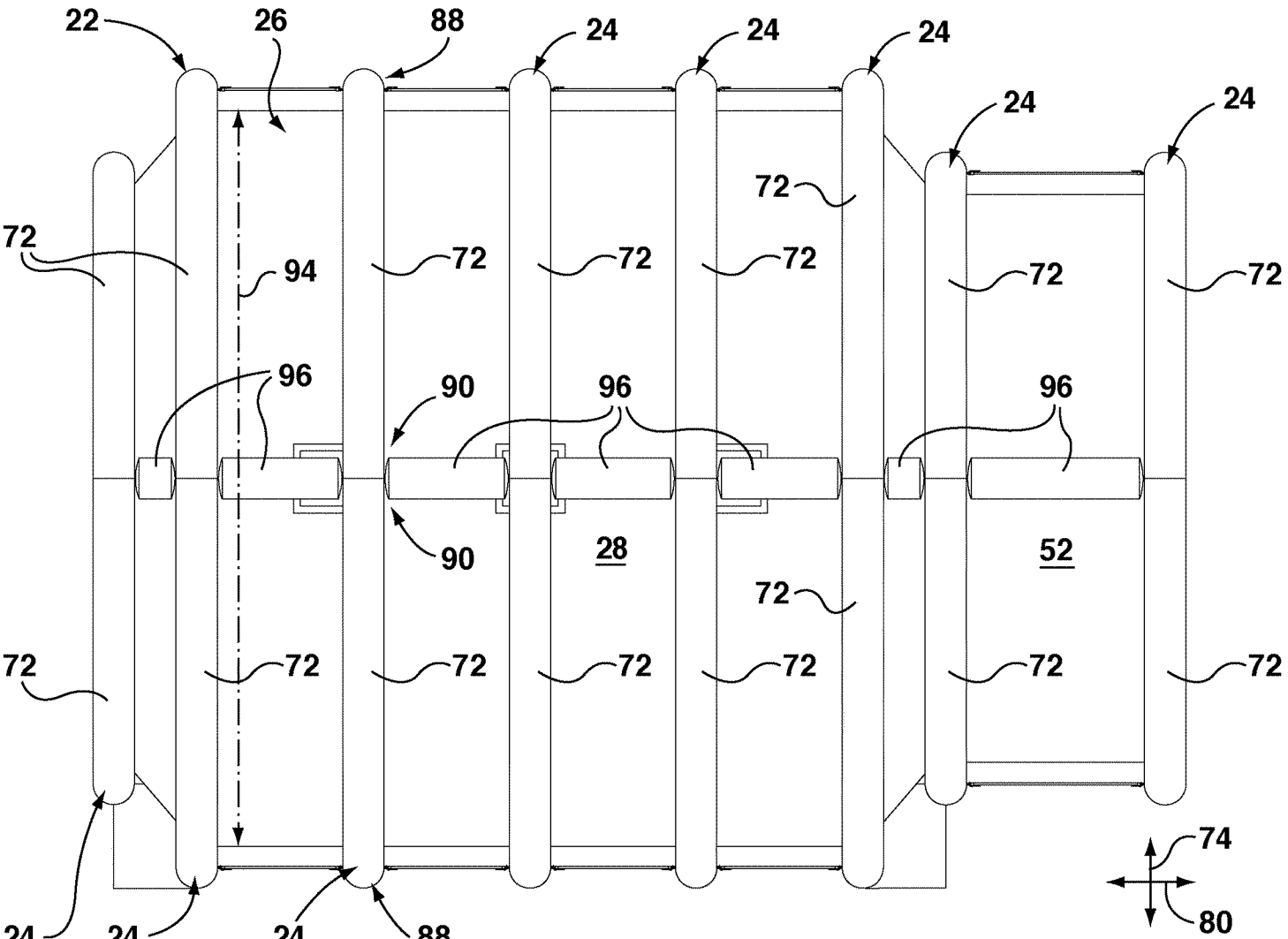

In the example illustrated, an inner end 90 of the transverse section 72 is spaced apart from the outer end 88 in the transverse direction 74, and is connected with the inner end 90 of the other transverse section 72 of the support member 24. A portion of the transverse sections 72 are shown to span the full width 94 of the chamber assembly 26 (FIG. 11). Each of the transverse sections 72 are also shown inclined upwardly between the outer and inner ends 88, 90, which may help to distribute load to the upright sections 76.

Figure 10:
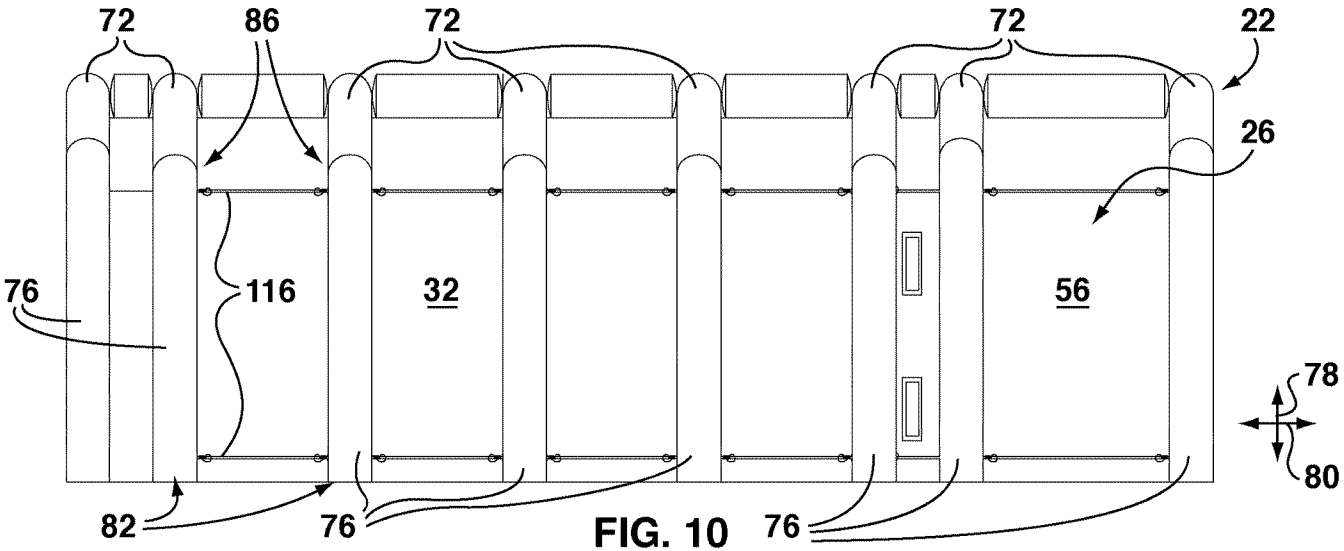

Referring to FIGS. 10 and 11, the support structure 22 is shown to further include longitudinal sections 96. The longitudinal sections 96 are shown to be elongate, generally cylindrical in shape, and extend generally in the longitudinal direction 80 between the transverse sections 72. In the example illustrated, the longitudinal sections 96 are arranged at an apex of the support structure 22, between the inner ends of the transverse sections 72, and may be attached to the transverse sections 72 by a suitable quick-connect coupling or other mechanism. The support members 24 may linked in fluid communication by the longitudinal sections 96 so that inflation of one of the support members 24 causes inflation of each of the support members 24. This may help to simplify inflation because only one inflation point may be necessary to inflate the entire support structure 22. However, it may still be desirable to have more than one inflation point, depending on the volume of air required to inflate the support structure 22. For example, there may be four inflation points, located in the upright section of four of the support member 24, near to the ground, and this may be sufficient to distribute air to all of the support members 24 to inflate the entire support structure 22.

The materials for the support structure 22 may be selected to be generally impervious to air, so that it remains inflated for long periods of time without topping up. Furthermore, the support structure 22 may be formed of a material that is mechanically tough for durability and longevity, and is also fire retardant.

By way of example, and not intended to be limiting, for forming the support structure 22, the inventors have had satisfactory results using a fabric material sold under the name PRECONTRAINT 832™ (Serge Ferrari of La Tour-du-Pin, France).

The apparatus 20 may include connectors for connecting the support structure 22 and the chamber assembly 26.

Figure 7:
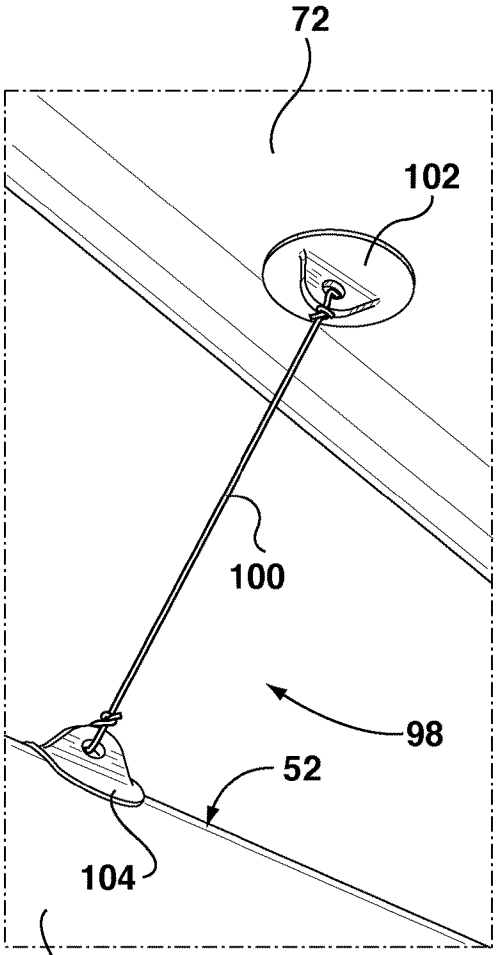
Figure 4:
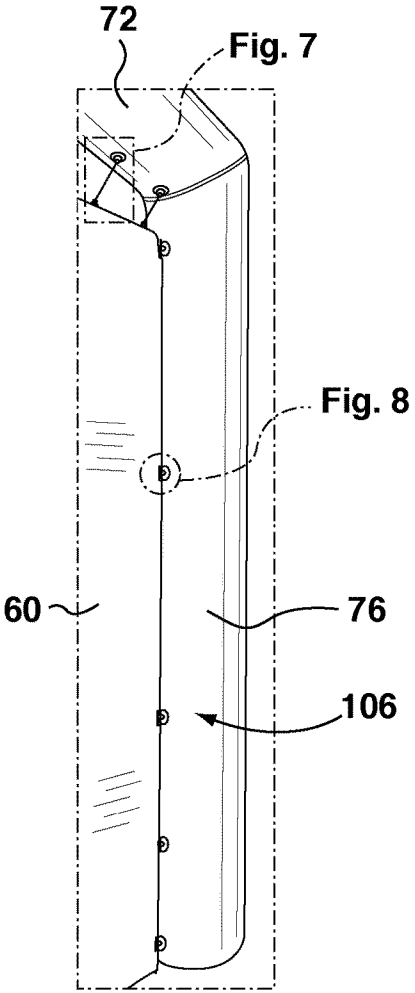
FIGS. 4 and 5 are detailed views of portions of FIG. 1.

Referring to FIGS. 1, 4 and 7, first connectors 98 are shown to connect the transverse section 72 to the top wall 52. In the example illustrated, referring particularly to FIG. 7, the first connector 98 includes a cable element 100 that is fixed to and extends between mounts 102, 104. The mounts 102, 104 are arranged on an interior side of the transverse section 72 and an exterior side of the top wall 52, respectively. The top wall 52 is therefore suspended from the transverse section 72 by the cable element 100. The cable elements 100 provide for a relatively simple connection, and may be easily replaced in the event that they become damaged.

The first connectors 98 may be used to connect each of the transverse sections 72 to the top walls 28, 52. In the example illustrated, many of the first connectors 98 are provided in a spaced apart manner along the length of each of the transverse sections 72 so that the top walls 28, 52 may be generally evenly supported across their widths (e.g., width 94 is shown in FIG. 11). This may help to ensure that the ceiling within the chamber assembly 26 is maintained relatively flat and smooth, to promote good airflow within the chamber assembly 26 and prevent or at least reduce allergen accumulation. Similarly, the bottom wall 30 may provide for a floor space that is flat, level, smooth and free of any obstacles or projections.

Figure 8:
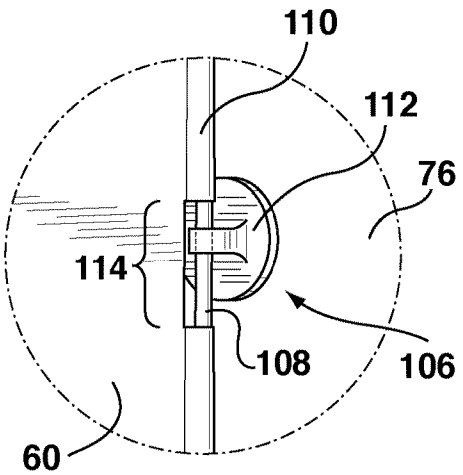
FIGS. 7 and 8 are detailed views of portions of FIG. 4.

Referring to FIGS. 1, 4 and 8, second connectors 106 are shown to detachably connect the upright section 76 to a corner between the side walls 58, 60. In the example illustrated, referring particularly to FIG. 8, the second connector 106 includes an elongate rod member 108. A sleeve 110 is mounted to the corner between the side walls 58, 60. A base 112 is mounted to an interior side of the upright section 76. The sleeve 110 includes a cutout or opening 114 in alignment with the base 112. Each of the sleeve 110 and the base 112 slidingly receive the rod member 108 to connect the side walls 58, 60 to the upright section 76.

The second connectors 106 may be used to connect each of the upright sections 76 to the side walls 32, 36, 34, 58, 60, 56. The second connectors 106 may serve to stretch out the material of the side walls 32, 36, 34, 58, 60, 56 so that each is maintained relatively flat and smooth, to promote good airflow within the chamber assembly 26 and prevent or at least reduce allergen accumulation.

In the example illustrated, the sleeve 110 is mounted along a full height of the chamber assembly 26 (e.g., height 92 in FIG. 9). Several bases 112 are shown spaced apart along the height of the upright sections 76, and the sleeve 110 has openings positioned correspondingly to the bases 112 to facilitate connection between the rod members 108 and the bases 112. For each of the upright sections 76 there may be a single rod member 108 that extends the full height of the chamber assembly 26, or there may be more than one rod member 108 extending in series. For example, there may be two rod members 108, each extending 4' in length, to cover an 8' height of the chamber assembly 26.

Figure 5:
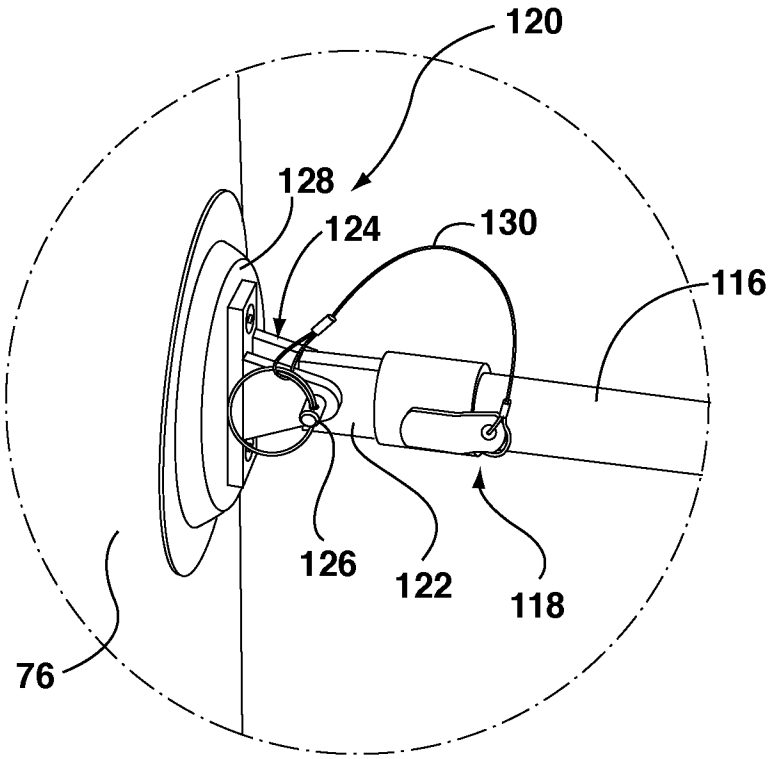

Referring to FIGS. 1 and 5, first spacer elements 116 are shown coupled between the support members 24. In the example illustrated, the spacer elements 116 extend between and are fixed to adjacent pairs of the support members 24, with one positioned adjacent the lower end 82 and one positioned adjacent the upper end 86 (FIG. 10). The spacer elements 116 may be detachably connected between the upright sections 76. Referring particularly to FIG. 5, an end 118 of the spacer element 116 may include a detachable connection 120. The detachable connection 120 may include a plate 122 that is received in a bracket 124, and held in place by a pin 126. The bracket 124 is fixed to the upright section 76 by a mount 128. The plate 122 is held in place relative to the bracket 124 by a pin 126, which may be retained by a wire 130.

Figure 6:
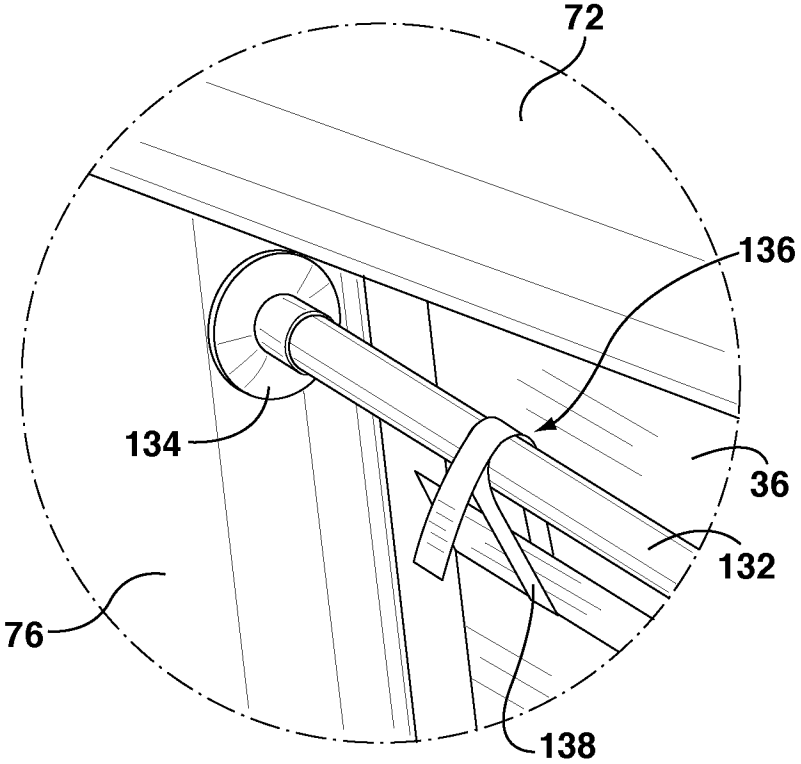
FIG. 6 is a detailed view of a portion of FIG. 2.

Referring to FIGS. 2 and 6, second spacer elements 132 are coupled between upright sections 76 at the rear of the apparatus 20. Ends of the spacer elements 132 are shown releasably retained in feet 134 that are fixed to the upright sections 76. In the example illustrated, the spacer elements 132 are detachably connected to the back side wall 36 by third connectors 136. The third connectors 136 may take the form of releasable loops 138 that are fixed to the back side wall 36 and receive the spacer element 132.

In the example illustrated, the apparatus 20 may be disassembled and moved to another location by disconnecting the second and third connectors and removing the spacer elements, deflating the support members 24, transporting the support structure 22 and the chamber assembly 26 to the second location, reinflating the support members 24, and reconnecting the second connectors, installing the spacer elements and reconnecting the third connectors.

Figure 12:
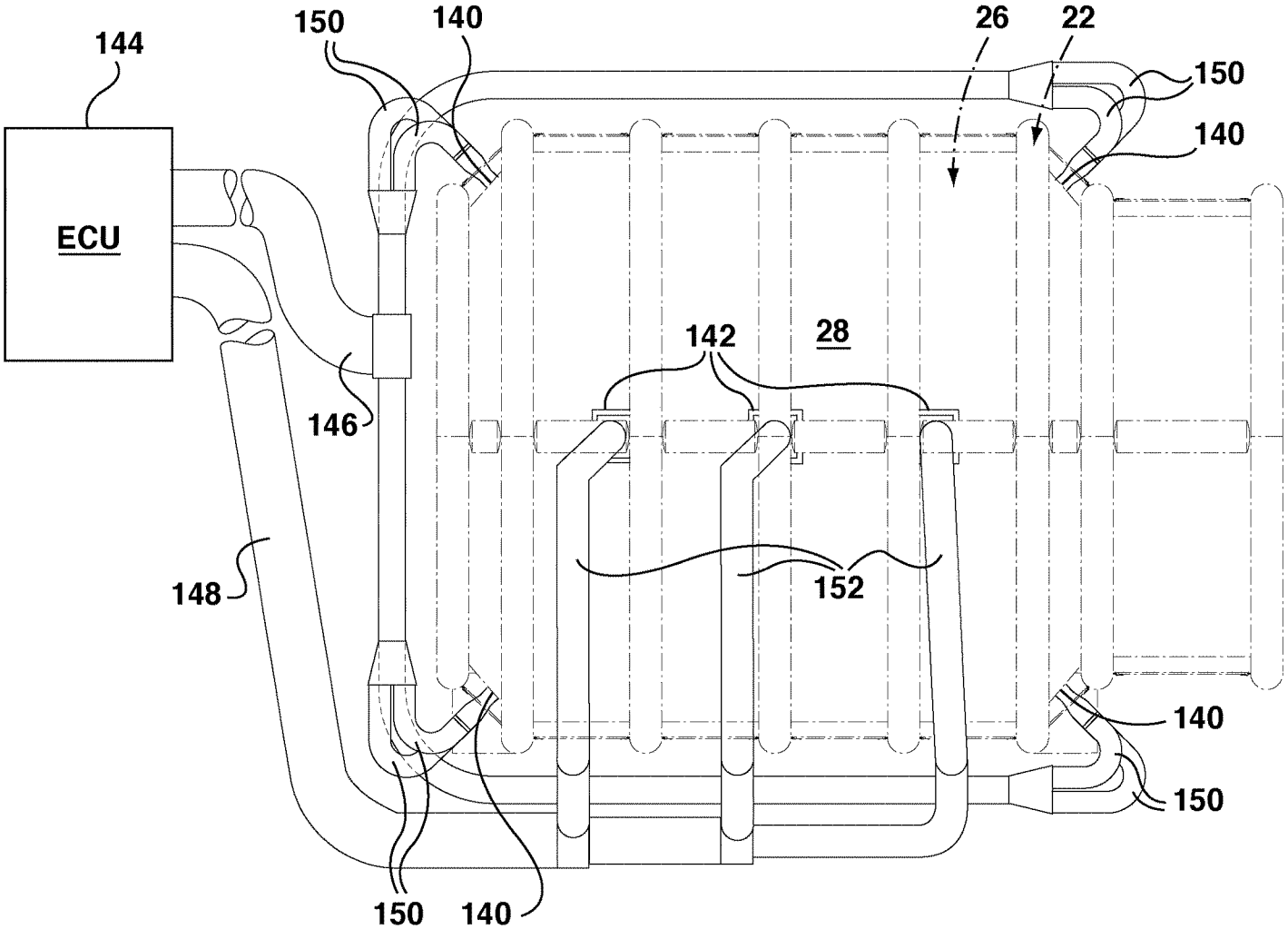
FIG. 12 is a top view of components of an environmental control unit (ECU) coupled to the mobile chamber apparatus of FIG. 1.

Referring to FIGS. 3 and 12, inlets 140 are disposed in each of the chamfered walls 44 for guiding or delivering a supply airflow to the interior space 42. In the example illustrated, each of the chamfered walls 44 has two inlets 140, which are positioned in a spaced apart manner between the top and bottom walls 28, 30. Given the relative dimensions of the interior space 42, and the orientation of the chamfered walls 44 relative the side walls 32, 34, 36, 38, the inlets 140 may deliver the supply airflow in a generally balanced and symmetrical manner, which may create air vortices within the interior space 42, reduce or eliminate "dead zones", and thereby promote uniform airflow and allergen mixing. However, other configurations may be possible, including, for example, configurations with more or less inlets for delivering the supply airflow, and/or configurations where the chamfered walls 44 are omitted and the inlets are disposed at the corners between the side walls 32, 34, 36, 38.

The chamber assembly 26 further includes outlets 142 for delivering a return airflow from the interior space 42. In the example illustrated, three of the outlets 142 are disposed in the top wall 28, and are positioned in a spaced apart manner between the back and front walls 36, 38. Thus, the outlets 142 are also arranged in a generally balanced and symmetrical manner within the interior space 42, which promotes uniform airflow and allergen mixing. Also, because allergens tend to settle within the interior space 42 by force of gravity, with the outlets 142 disposed in the top wall 28, above the inlets 140, this arrangement may reduce the amount of allergen that is entrained in the return airflow to be expelled from the interior space 42.

Referring particularly to FIG. 12, an ECU 144 may provide the supply airflow, at a precisely controlled temperature and humidity that may be required to effectively aerosolize allergens. The ECU 144 may also be configured to provide clean, filtered air that excludes plant pollens and allows for the careful exposure to patients of the desired allergen. Furthermore, the ECU 144 may provide a pressure gradient necessary to help retain allergen within the interior space 42.

In the example illustrated, the ECU 144 is connected to a main supply duct 146 and a main return duct 148. The main supply duct 146 feeds inlet ducts 150 and outlet ducts 152 feed the main return duct 148. The ducts 146, 150 deliver the supply airflow through the inlets 140 to the interior space 42. The ducts 152, 148 deliver the return airflow from the interior space 42 through the outlets 142. For the ducts 150, 152, the inventors have had satisfactory results using a flexible suction (spiral) duct obtained from Schauenburg Industries Ltd., of North Bay, Ontario.

Figure 13:
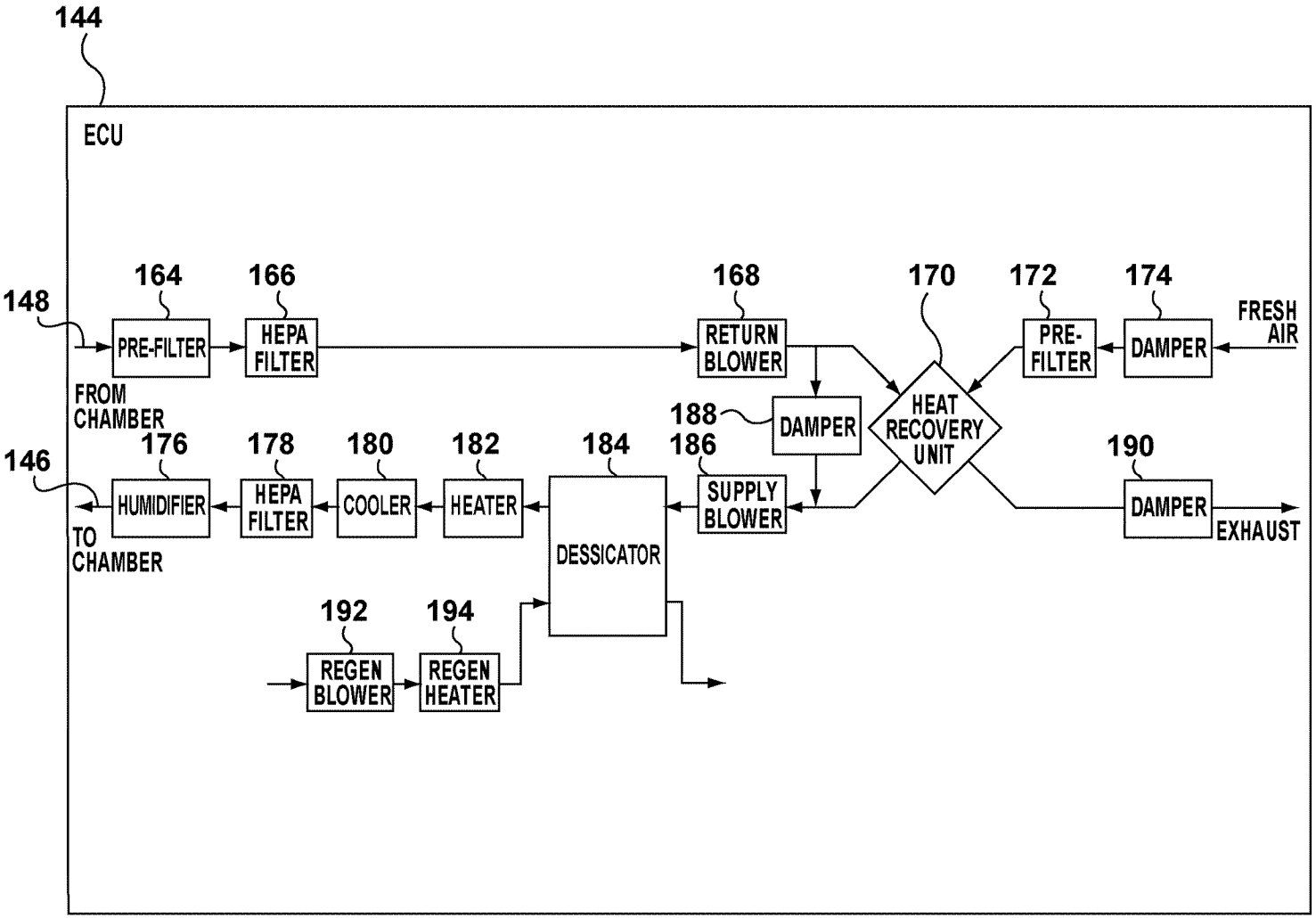
FIG. 13 is a schematic drawing of the ECU.

Referring to FIG. 13, the ECU 144 includes several components that enable the delivery of that supply airflow that is relatively clean and may be controlled to be at certain temperatures and humidity levels. Fresh air is introduced to the ECU 144 and passes through a damper 174 and a pre-filter 172 to a heat recovery unit 170. At the heat recovery unit 170, heat may be exchanged between the return airflow and the fresh air. A supply blower 186 forces the warmed, fresh air through a dessicator 184 for dehumidification. The dessicator 184 may include one or more desiccating wheels. A separate counterflow of air is forced by a regen blower 192 through a regen heater 194, to remove moisture from the dessicator 184. After the dessicator 184, the dehumidified, warmed fresh air passes through a heater 182, a cooler 180, a HEPA filter 178 and a humidifier 176, and then is supplied to the main supply duct 146. The HEPA filter 178 filters the air and eliminates, as best as possible, any allergen content or other impurities of the incoming airflow. Each of the heater 182, the cooler 180 and the humidifier may be operated independently in order to attain the supply airflow at the desired temperature and humidity characteristics. From the main return duct 148, the return airflow may also filtered using a pre-filter 164 and a HEPA filter 166 to remove or at least substantially reduce any allergen entrained with the return airflow. A return blower 168 forces this air through the heat recovery unit 170 and a damper 190 to be exhausted to the outside. During normal operation, a damper 188 is in a closed position, and the dampers 174, 190 are in an opened position. During a recirculation mode, the damper 188 is moved to an opened position so that the return airflow from the main return duct 148 is supplied back to the main supply duct 146, and the dampers 174, 190 are moved to a closed position, thereby blocking the flows of fresh air into the ECU 144 or exhaust air out of the ECU 144.

Figure 14:
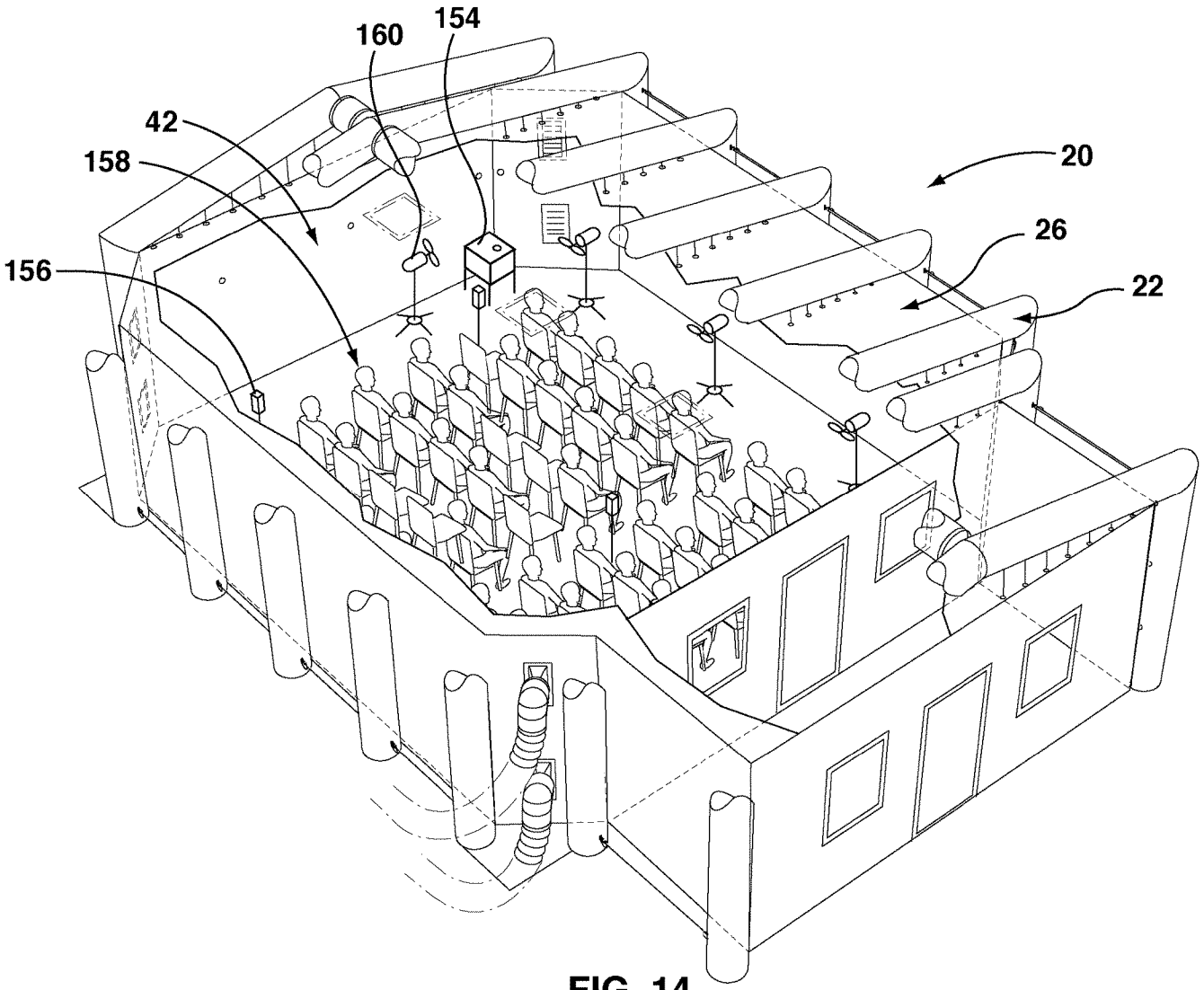
FIG. 14 is a front perspective cutaway view of the mobile chamber apparatus of FIG. 1, showing an interior space thereof.
Figure 15:
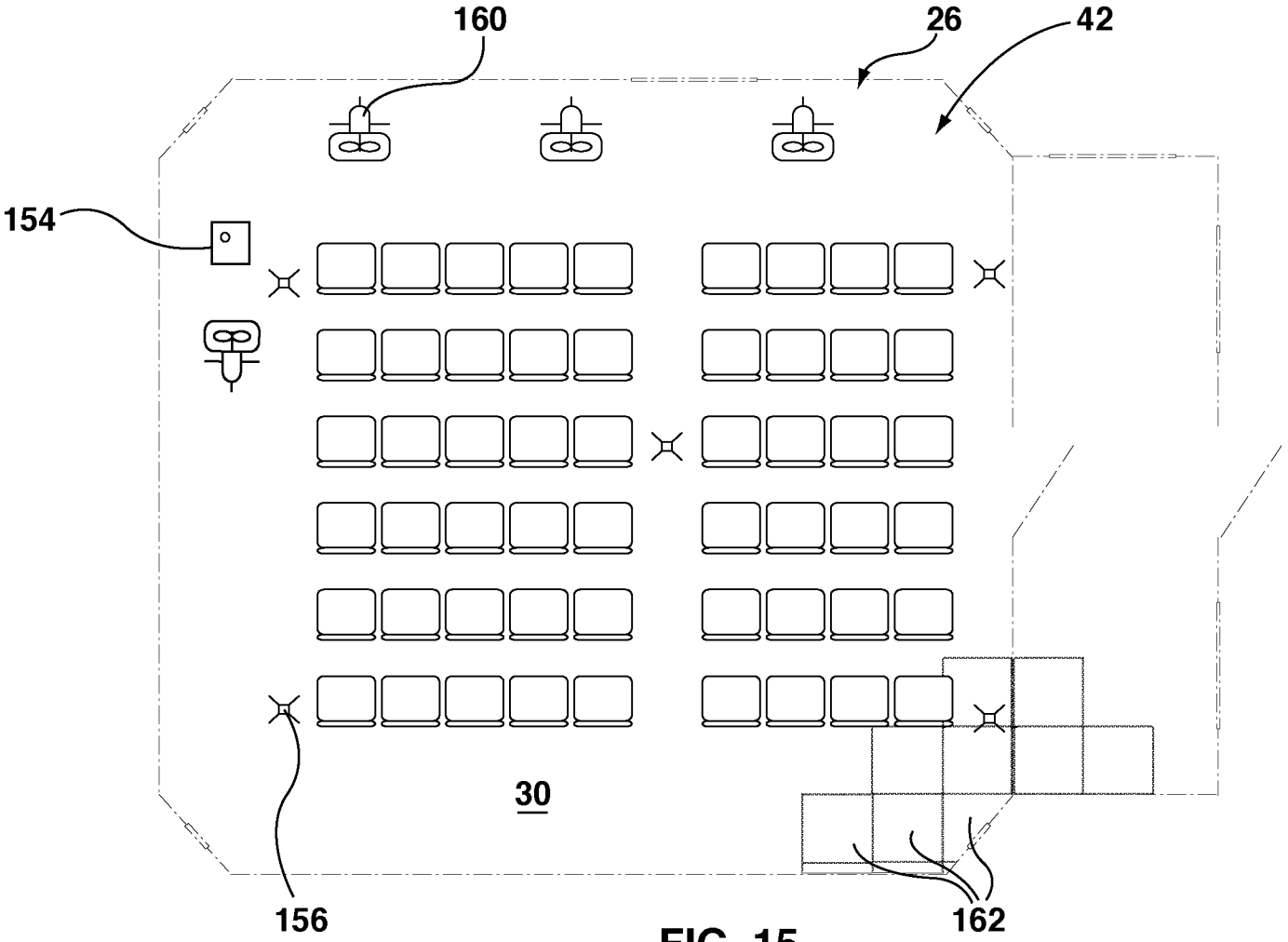
FIG. 15 is a top schematic view of the interior space of the mobile chamber apparatus of FIG. 1.

In use, referring now to FIGS. 14 and 15, the apparatus 20 is shown in the installed state with the support structure 22 supporting the chamber assembly 26, which encloses the interior space 42. At least one mechanism 154 may be provided for introducing an allergen into the interior space 42, and at least one sampling mechanism 156 may be provided for measuring the allergen level within the interior space 42. Human patients 158 may be exposed to the allergen in the interior space 42, and the exposure of the human patients 158 to the allergen may be assessed.

Optionally, fans 160 may be provided to ensure uniform mixing of the allergen within the interior space 42. Also, if the material for the bottom wall 30 is not durable enough for long-term use, then auxiliary flooring 162 may be used. Interlocking, electrostatically dissipative flooring may be used to prevent static buildup while also providing a practical hard surface for chair set up and easy cleaning. The inventors have had satisfactory results using SELECTILE ESD™ interlocking static control floor tiles. Furthermore, recessed mounts may be used to encase fluorescent light fixtures and allow for unencumbered airflows, and other recessed mounts may be used for electrical outlets, sensors and other connections within the chamber assembly 26.

By way of example, and not intended to be limiting, the apparatus 20 may be dimensioned so that the interior space 42 is approximately 1000 square feet, which may accommodate 50-60 patients seated. These relatively large dimensions may allow for the simultaneous testing of many patients who are all exposed to the same airborne allergen level for the same time period.

The apparatus 20 may allow for mobile or portable EEC allergen testing in which the capabilities of spatial and temporal airborne allergen consistency and control that are present in the static EEC are present and operated according to standardized operating procedures. The apparatus 20 may be designed to travel in a standardized container suitable for multiple transportation types, including truck, rail and boat. The ECU 144 may also be designed for travel, implemented in a single container that may be deployed with the container housing the apparatus 20 when transported to the clinical locations. In some cases, the ECU 144 may be built into a standard shipping container.

As mentioned above, it may be important for the consistency required for drug testing that allergen exposure is kept generally constant in the interior space 42 and is dispersed in a spatially uniform manner across the patient seating area, and that this exposure is maintained over the course of an entire allergen exposure session, which may range from 1 hour to 14 hours, for example.

As mentioned above, chamber assembly 26 may be constructed of anti-static and electrostatically dissipative textiles, including walls, ceiling and flooring. This may allow for better aerosolization of allergens such as pollens, so the pollens do not buildup or accumulate regions of the interior space 42 and thereby become a 'sink' or source of pollen, thus resulting in an inability to control airborne pollen over time. Furthermore, the materials utilized for the chamber assembly 26 may be selected so as not have any appreciable outgassing of odors which may influence patient response to allergen. This may avoid or at least reduce bias of patients' responses to allergen due to positive or negative odor interpretation. Air quality with respect to outgassing may be tested to ensure that Volatile Organic Compound (VOC) levels are low to undetectable. A hand-held VOC meter may be utilized to test a representative number of regions within the interior space 42. This meter and other measurement equipment may be included with the apparatus 20 and the ECU 144 when transported.

In some cases, the mechanism 154 for introducing allergen into the interior space 42 may be an aerosolization apparatus that provides for pollen particle aerosolization, without particle agglomeration by removal of particle charge and mixing with a dry clean air jet stream. This may allow pollen levels of a plant pollen allergen type, such as ragweed, to be controlled the interior space 42 to, e.g., 3500±500 pollen grains per cubic meter of air, which may be consistent with levels previously used in other studies. This system is utilized directly within the MEU and thereby promotes easy set-up and validation of the MEU to specifications. Different mechanisms may be used for introducing non-plant allergens, such as dust mite and cat allergen, which may have a higher specific density and a higher propensity to agglomerate.

Plant allergens or pollens may be sourced from the same supplier and have been well qualified for content and handling. Non-pollens may also be purchased from the same provider, and handled according to manufacturer instructions. Milled cat and dust mite allergen may be utilized with an allergen content measured and provided. The same batch lot may be utilized wherever possible throughout the course of a single study. Either dust mite species—*Dermatophagoides pteronyssinus* (Der p) or *Dermatophagoides farinae* (Der f)—may be aerosolized within a range of, e.g., 20-500 $ng/m^3$. In the case of cat allergen, the major cat allergen fells *domesticus* type 1 may be measured and is maintained within 50-200 $ng/m^3$.

In the case of pollen aerosolization, rotorods may be implemented as the sampling mechanism 156 within the interior space 42. In the example illustrated, several of the sampling mechanisms 156 are positioned in a spaced apart manner in the interior space 42, and may be used to obtain an adequately representative sampling of the patient seating area to determine average airborne allergen levels.

In the case of non-plant allergens, such as dust mite or cat allergens, a personal air sampler may be implemented as the sampling mechanism 156. The personal air samplers may be mounted on stands and connected to pumps that simulate a breathing rate. The personal air samplers include a filter upon which airborne allergen is collected at a rate that is representative of the amount that a person would inhale. After a desired collection time, the filters are removed and the allergen may be eluted and quantitated. In some cases, an Enzyme-Linked Immunosorbant Assay (ELISA) may be used to measure the amount of dust mite or cat allergen.

Since ELISA may require 8-24 hours to obtain results, a laser particle counter may also be used to measure any change in particle size and number in the interior space 42. This may be used as a real-time measure for patient safety and determination of allergen range aerosolized.

Standardized operating procedures may be implemented for the apparatus 20 and used as the basis for operation and training in order to standardize the allergen aerosolization in all clinical sites. This may promote the utility of multicenter trials using the apparatus 20 for the study of allergic patients.

Validation testing may also be performed to ensure that patient allergen exposure within the apparatus 20 is within normal ranges, consistent and well controlled. Firstly, after the apparatus 20 has been installed at the clinical site, it may be calibrated to certain specifications according to an Installation Qualification (IQ), the results of which may be documented and archived. Secondly, once both the apparatus 20 and the ECU 144 are connected at the clinical site, an Operational Qualification (OQ) may be conducted to see that all individual elements are operating such that the system is operating within specification. The last step in the validation process is to see that system performs within the range of airborne allergen exposure for patients that is required. This is called a Performance Qualification (PQ). The PQ may performed to demonstrate that there is spatial and temporal airborne allergen over the area of the patient seating. This may ensure that allergen levels are adequately controlled and there is consistent patient allergen exposure. Further testing may also be performed to demonstrate that even with disassembly of the apparatus 20 and reassembly at a second location, the validation results are within the desired ranges.

While the present disclosure describes the support structure 22 as being external of the chamber assembly 26 for supporting the chamber assembly 26, and with the support structure 22 and the chamber assembly 26 as being separate elements, other arrangements are possible, including configurations where the support structure is arranged at least partially internally of the chamber assembly, and configurations where the support structure and the chamber assembly are at least partially integrated. Various configurations are possible.

While the present disclosure emphasizes the use of the mobile chamber apparatus for allergy and rhinitis studies, it should be appreciated that the mobile chamber apparatus may be used for other testing, including, without limitation, chronic obstructive pulmonary disease testing, chemical products and fragrance testing, pollution testing, and occupational exposure testing. Various other applications may be possible for the mobile chamber apparatus, where it is desirable to have a mobile chamber within which the environment of the interior space may be carefully controlled. Such other applications may include, without limitation, mobile field operating rooms and hospitals, hazardous material and quarantine situations, and other military applications.

While the above description provides examples of one or more processes or apparatuses, it will be appreciated that other processes or apparatuses may be within the scope of the accompanying claims.

We claim:

1. A mobile chamber apparatus, comprising:

a support structure comprising a plurality of inflatable support members, each of the plurality of inflatable support members including at least one transverse section and at least one upright section;

a chamber assembly comprising a top wall, a bottom wall, and at least one side wall coupled between the top and bottom walls; and a plurality of connectors for detachably coupling the support structure to the chamber assembly, the plurality of connectors including a plurality of first connectors that couple the at least one transverse section to the top wall and a plurality of second connectors that detachably couple the at least one upright section to the at least one side wall, wherein, in an installed state, the support structure is coupled to the chamber assembly and supports the chamber assembly so that the top wall, the bottom wall and the at least one side wall enclose an interior space, wherein the plurality of first connectors comprise a plurality of cable elements spaced apart generally along a length of the at least one transverse section, each of the plurality of cable elements fixed to and extending between an exterior surface of the at least one transverse section and an exterior side of the top wall so that the top wall is at least partially suspended from the at least one transverse section, and wherein each of the plurality of second connectors comprises:

at least one sleeve mounted to one of the at least one upright section and an exterior side of the at least one side wall;

at least one base mounted to the other of the at least one upright section and the exterior side of the at least one side wall; and at least one elongate rod member that couples the at least one base and the at least one sleeve.

2. The apparatus of claim 1, wherein the at least one base and the at least one sleeve each slidingly receive the at least one rod member.

3. The apparatus of claim 2, wherein the at least one sleeve is mounted generally along a height of the at least one side wall, and the at least one rod member extends generally along the height of the at least one sidewall.

4. The apparatus of claim 3, wherein the plurality of second connectors comprises a further plurality of bases spaced apart generally along a height of the at least one upright section, and the at least one sleeve comprises a plurality of openings, each of the plurality of openings positioned correspondingly to a respective one of the plurality of bases, the openings facilitating connection between the at least one rod member and the further plurality of bases.

5. The apparatus of claim 1, further comprising a plurality of spacer elements coupled between the plurality of inflatable support members.

6. The apparatus of claim 5, wherein each of the plurality of spacer elements extends between and is fixed to an adjacent pair of the plurality of inflatable support members.

7. The apparatus of claim 6, wherein each of the plurality of spacer elements comprises first and second ends that are each detachably connected to a respective at least one upright section of the adjacent pair.

8. The apparatus of claim 7, wherein at least a portion of the plurality of each of the plurality of spacer elements are coupled to the at least one side wall.

9. The apparatus of claim 8, wherein the plurality of connectors further comprise third connectors that detachably couple the portion of each of the plurality of spacer elements to the at least one side wall.

10. The apparatus of claim 9, wherein the third connectors comprise releasable loops that are fixed to the at least one side wall and receive the portion of each of the plurality of spacer elements.

11. The apparatus of claim 1, wherein the at least one upright section of each of the plurality of inflatable support members comprises first and second elongate upright sections, and the at least one transverse section extends between upper ends of the first and second upright sections.

12. The apparatus of claim 11, wherein the at least one transverse section comprises first and second elongate transverse sections, an outer end of each of the first and second elongate transverse sections coupled to the upper end of a respective upright section.

13. The apparatus of claim 12, wherein inner ends of the each transverse sections are coupled together, and each of the transverse sections are inclined upwardly between the outer and inner ends.

14. The apparatus of claim 13, wherein, for each of the plurality of inflatable support members, the upright and transverse sections are linked in fluid communication so that inflation of the support structure causes inflation of each section.

15. The apparatus of claim 14, wherein the support structure further comprises a plurality of longitudinal sections that extend between the first and second transverse sections.

16. The apparatus of claim 15, wherein each of the plurality of inflatable support members is further linked in fluid communication by the plurality of longitudinal sections so that inflation of one of the plurality of inflatable support members causes inflation of each of the plurality of inflatable support members.

17. The apparatus of claim 1, further comprising an environmental control unit coupled to the apparatus for delivering a supply airflow to the interior space.

18. A kit of parts, comprising:

a plurality of inflatable support members, each of the plurality of inflatable support members comprising at least one transverse section and at least one upright section;

a top wall;

at least one side wall;

a plurality of first connectors for coupling the at least one transverse sections to the top wall; and a plurality of second connectors for coupling the at least one upright sections to the at least one side wall, wherein each of the plurality of second connectors comprises:

at least one sleeve mounted to one of the at least one upright section and an exterior side of the at least one side wall;

at least one base mounted to the other of the at least one upright section and the exterior side of the at least one side wall; and at least one elongate rod member that couples the at least one base and the at least one sleeve, wherein, in an installed state, the at least one upright transverse sections support the top wall and the upright sections support the at least one side wall so that the top wall and the at least one side wall enclose an interior space.

* * * * *